United States Patent [19]

Blair

[11] 4,301,360

[45] Nov. 17, 1981

[54] TIME INTERVAL METER

[75] Inventor: Bruce W. Blair, Beaverton, Oreg.

[73] Assignee: Tektronix, Inc., Beaverton, Oreg.

[21] Appl. No.: 88,261

[22] Filed: Oct. 25, 1979

[51] Int. Cl.[3] ..... G07C 1/02

[52] U.S. Cl. ..... 235/92 T; 235/92 NT; 368/121

[58] Field of Search ..... 235/92 T, 92 NT; 368/107, 121

[56] References Cited

U.S. PATENT DOCUMENTS 3,790,890 2/1974 Doittau et al. ..... 368/121

3,970,828 7/1976 Klein ..... 235/92 T

*Primary Examiner*—Joseph M. Thesz

*Attorney, Agent, or Firm*—George T. Noe

[57] ABSTRACT

A time interval meter for measuring extremely short time intervals includes a timing circuit operable at a fast predetermined rate over the time interval between first and second events, and operable at a slow predetermined rate which is precisely scaled to the first rate over a time interval between the occurrence of the second event and the upper limit of a predetermined timing window. During the slow ramp period, clock pulses are counted to provide a count which is proportional to that portion of the predetermined timing window occupied by the slow ramp interval. The fast ramp time interval may then be readily attained by subtracting the slow ramp interval from the total time of the timing window. The circuit includes a control circuit, a timing circuit including a capacitor and a pair of selectable constant current sources, and a counter.

9 Claims, 2 Drawing Figures

μP
50
COUNTER
CLR
48
42
40
10 MHZ CLOCK
44
+12V
100μA
22
10mA
20
+V
34
32
30
28
24
TIMING CAP
+2.0V
54
60
-12V
58
56
12
10
D
Q
INITIALIZE
16
SAMPLE CLOCK
18
TRIGGER SIGNAL
VOLTS
2.0
0
80
82
84
$t_1$
$t_2$
$t_T$
$t_0$
$t_2$ EXPANDED
$t_T$ EXPANDED

TIME INTERVAL METER

BACKGROUND OF THE INVENTION

The present invention relates generally to devices for measuring elapsed time, and in particular to a time-interval meter for measuring extremely short time intervals.

Conventional time measurement circuits typically employ direct counting techniques or ratios of counts in frequency /period measurements. One such technique is to gate a digital counter on upon some event, and stop the counter upon the occurrence of a second event. The counter counts clock pulses between the two events, and consequently the measured time interval has an error of ± one count. For long time intervals measured by counting high-speed clock signals, the one-count error may be inconsequential. However, for short time intervals, for example, in the sub-microsecond range, the count error becomes significant. In the prior art, this problem is overcome by employing an extremely high-speed clock and associated highspeed counter circuits, with attendant added complexity and high cost.

SUMMARY OF THE INVENTION

In accordance with the present invention, a simple and inexpensive time interval meter is provided for measuring extremely short time intervals, such as the time difference between a signal-related trigger and a next successive sampling clock edge in a digital oscilloscope. A timing circuit operable within a predetermined timing window includes a capacitor which is chargeable at two different predetermined rates, with the slower rate establishing a predetermined maximum time interval. In the preferred embodiment, the charging rates are precisely scaled to a ratio of 100:1.

At the interval start, for example, upon receipt of a trigger signal, the capacitor begins to charge at the faster rate. At the interval stop, for example, upon receipt of a sampling clock edge, the charging rate is switched, and the capacitor continues to charge at the slower rate. Also at the interval stop, a counter is activated to count clock pulses during the slow-rate portion of the capacitor-charging cycle. When the capacitor charges to a predetermined voltage level which corresponds to the maximum time interval, the counter is stopped. The count thus obtained at the slower rate is scaled by the fast rate-slow rate ratio, e.g., divided by 100 in the preferred embodiment, to provide an actual measured time interval which is subsequently subtracted from the predetermined maximum time interval to yield the desired time interval measurement between the two events.

It is therefore one object of the present invention to provide a novel time interval meter.

It is another object to provide a time interval meter for measuring short, i.e., sub-microsecond, time interval measurements using lower speed clock and counter circuits.

It is a further object to provide a time interval measurement circuit which employs time scaling during the operation thereof to increase measurement accuracy.

Other objects and attainments of the present invention will become apparent to those skilled in the art upon a reading of the following detailed description when taken in conjunction with the drawings.

DRAWINGS

FIG. 1 is a schematic diagram of a time interval meter in accordance with the present invention; and FIG. 2 is a timing diagram showing the time interval measurement.

DETAILED DESCRIPTION OF THE DRAWINGS

Figures 1, 2:
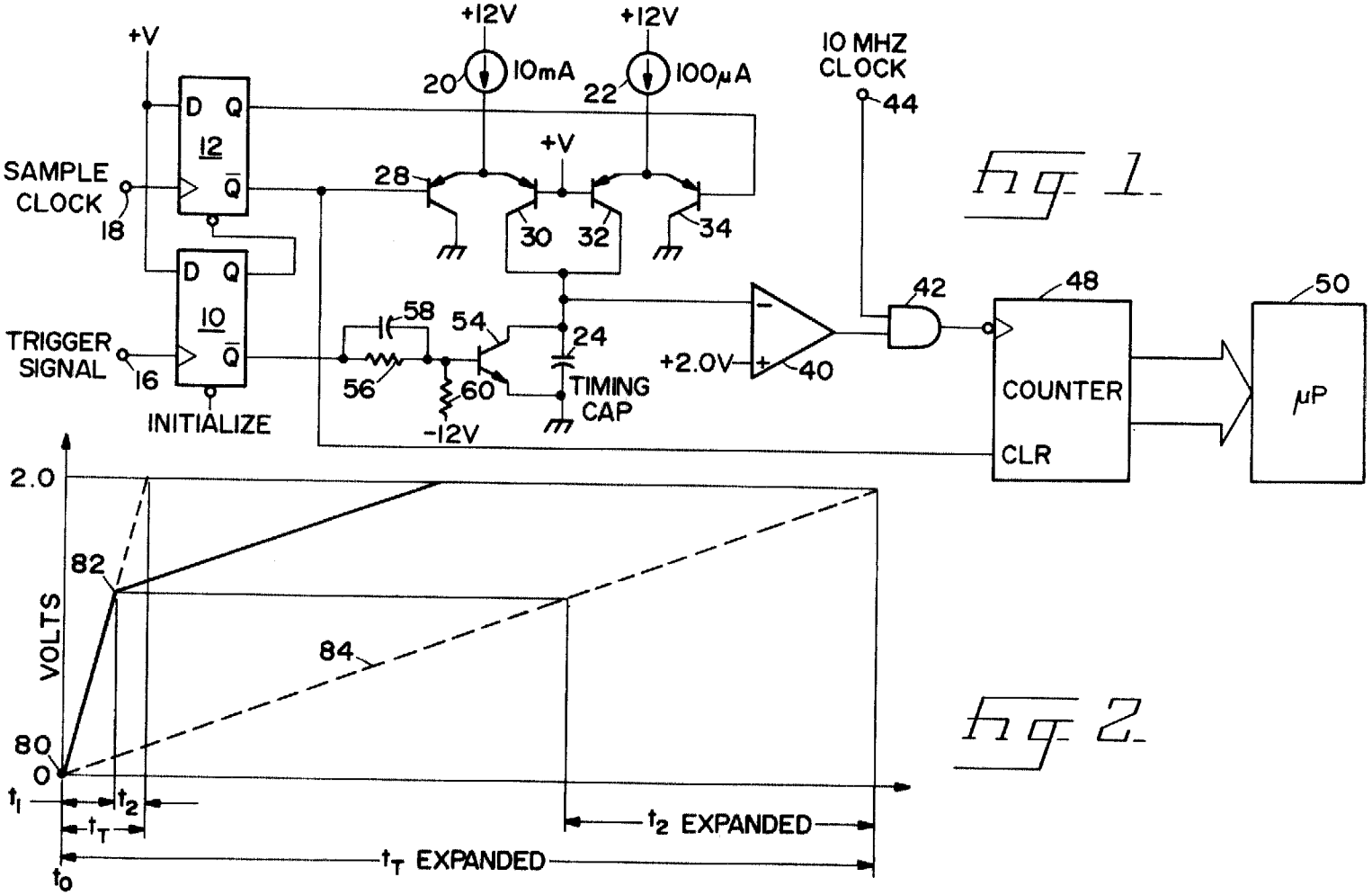

The preferred embodiment of the present invention is a time interval meter for measuring elapsed time between a signal-related trigger and a next successive sampling clock edge in a digital oscilloscope in order to correct jitter resulting from ± one-half sample period error. Referring now to FIG. 1, a pair of edge-triggered D flip-flops 10 and 12 control the operation of the time interval meter in response to a trigger signal applied to an input terminal 16 and a sample clock signal applied to an input terminal 18. The circuit operation will be discussed in detail later in connection with FIG. 2.

A pair of current sources 20 and 22 provide constant charging current for a timing capacitor 24. Current source 20 is connected between a suitable source of positive supply voltage, such as +12 volts, and the emitters of an emitter-coupled pair of transistors 28 and 30. Current source 22 is connected between the +12-volt supply and the emitters of a second emitter coupled pair of transistors 32 and 34. These emitter-coupled transistors provide current switching, as will be described later, and permit only one of the two current sources 20 and 22 to be coupled to the timing capacitor 24 at any given time. The bases of transistors 30 and 32 are connected together to a suitable level of reference voltage, while the collectors thereof are connected together and to one side of the capacitor 24, the other side of which is connected to ground. The collectors of transistors 28 and 34 are both connected to ground, and the bases thereof are connected to the $\overline{Q}$ and Q outputs respectively of flip-flop 12.

A comparator 40 has its inverting (−) input connected to the away-from-ground side of capacitor 24, and its non-inverting (+) input connected to a precise reference voltage. The output of comparator 40 is connected to one input of an AND gate 42. A clock signal is applied via a terminal 44 to a second input of AND gate 42. The output of AND gate 42 is connected to the toggle input of a binary counter 48. The Q output of flip-flop 12 is connected to the clear input of counter 48. The count data that is produced by counter 48 is send to a processing circuit, such as a microprocessor (μP) 50.

The timing capacitor 24 is resettable by a transistor 54, the collector and emitter of which are connected across the capacitor. The base of transistor 54 is coupled to the $\overline{Q}$ output of flip-flop 10 via a parallel combination of resistor 56 and speed-up capacitor 58. A resistor 60 is connected between the base of transistor 54 and a suitable source of negative voltage, e.g., −12 volts, to hold the transistor in a normally cut off mode. Transistor 54, while shown as a bipolar transistor, could be a field-effect transistor as well.

The circuit operates as follows: Initially, flip-flop 10 is cleared, so that its Q output is low and its $\overline{Q}$ output high. Transistor 54 is turned on to saturation, holding timing capacitor 24 completely discharged. Flip-flop 12 is cleared by the low Q output of flip-flop 10, so that its Q output is low and its $\overline{Q}$ output high. Transistors 30 and 34 are turned on, while transistors 28 and 32 are off, so that current from current source 20 flows to ground through transistors 30 and 54, and the current from current source 22 flows to ground through transistor 34. With the top of timing capacitor 24 virtually grounded, the output of comparator 40 is high, allowing clock signals to pass through AND gate 42 to the counter, which is held in a cleared condition by the high $\overline{Q}$ output of flip-flop 12 and thus produces no count output. This completes the initial conditions for the time interval circuit.

Upon receipt of a trigger signal at terminal 16, the outputs of flip-flop 10 switch states, releasing flip-flop 12 and transistor 54. Transistor 54 switches off, permitting all of the current from current source 20 to flow into the timing capacitor 24. The charging voltage as a function of time within a predetermined timing window for capacitor 24 is shown in FIG. 2, with the triggering point 80 occurring at time $t_o$. If allowed to charge at this rate completely to the 2-volt switching level of comparator 40, the 2-volt point would be reached within a predetermined time interval $t_T$, which is selectable from $t_T$=200 nanoseconds, 100 nanoseconds, or 40 nanoseconds in the preferred embodiment. These time intervals $t_T$ were chosen for the preferred embodiment to facilitate measurement of the time difference between a trigger signal and a next successive edge of a sample clock at different sweep rates wherein the sampling clock rates are 5, 10, and 25 megahertz respectively.

At some point within the time interval $t_T$, then, the sample clock edge arrives, causing the Q and $\overline{Q}$ outputs of flip-flop 12 to switch states, turning transistors 28 and 32 on, and 30 and 34 off, and removing the clear signal from counter 48. At this point, shown by the breakpoint 82 in FIG. 2, current from current source 22 flows into the capacitor while the current from current source 20 flows to ground through now-conducting transistor 28. In the preferred embodiment, current source 20 provides 10 milliamperes (mA) of current, while current source 22 provides 100 microamperes ($\mu$A) of current, so that a precise 100:1 scaling ratio exists between the two. Therefore, after receipt of the sample clock edge, the timing capacitor charges toward the 2-volt limit at a one hundredth slower rate, during which time the counter, no longer being held clear, counts the 10-megahertz clock signals arriving via AND gate 42. The slower charge rate is shown as the dashed line 84 in FIG. 2, and it should be noted that the ratio of the slopes is approximately 10:1 to facilitate illustration of the concept. The particular ratio actually chosen depends upon the situation and the measurement accuracy desired.

When the timing capacitor 24 charges to the 2-volt limit, comparator 40 switches and the output thereof goes low, causing AND gate 42 to block the counter 48 from the clock signals. The contents of counter 48 at this point, which have been counted over an expanded $t_2$ time interval, represent the actual time interval $t_2$ because of the precise scaling. That is, each count of 100 nanoseconds of the slow charging current is equivalent to one nanosecond at the fast charging current. The microprocessor 50 subtracts the $t_2$ interval from the predetermined time interval $t_T$ to yield the time interval $t_1$ between the two events of trigger signal and sampling clock edge.

Circuit imperfections may be corrected by the microprocessor 50 as well. For example, in the saturated condition of transistor 54, the capacitor 24 may actually have a couple of tenths of a volt thereacross, requiring an adjustment of the comparator reference voltage to provide a precise 2-volt time interval window. The microprocessor may correct for this offset by keeping track of minimum and maximum counts received on repetitive cycles and adjust the raw data.

The time interval meter is cleared and reset to the initial conditions upon application of an initialize signal to the clear input of flip-flop 10. The initialize signal may be generated in a number of ways after the count signal is converted to a measurement, and is generated by the microprocessor 50 in this embodiment.

Although the present invention has been described in connection with a particular embodiment thereof, it is to be understood that additional embodiments, modifications, and applications thereof which will be obvious to those skilled in the art are included within the spirit and scope of the invention.

What I claim as being new is:

1. A time interval meter, comprising:

a timing circuit operable at first and second predetermined rates within a predetermined timing window, said second rate being proportionately slower than said first rate;

control circuit means responsive to a start signal and a stop signal for causing said timing circuit to operate at said first predetermined rate over a first time interval determined by the time difference between said start and stop signals, and for causing said timing circuit to operate at said second predetermined rate over a second time interval determined by the time difference between said stop signal and the upper limit of said predetermined timing window;

means connected to said timing circuit for measuring said second time interval to provide a measured value; and means for subtracting said measured value from said predetermined timing window to provide a measurement of said first time interval.

2. A time interval meter in accordance with claim 1 wherein said timing circuit comprises a capacitor and first and second constant current sources connectable to said capacitor, and wherein said control circuit means includes transistor switch means for connecting said first constant current source to said capacitor upon receipt of said start signal, and for disconnecting said first constant source from said capacitor and connecting said second constant current source to said capacitor upon receipt of said stop signal.

3. A time interval meter in accordance with claim 2 wherein said timing circuit further includes a comparator having one input thereof connected to said capacitor, and a second input thereof connected to a reference voltage to establish the upper limit of said timing window.

4. A time interval meter in accordance with claim 2 wherein said control circuit means further includes means for holding said capacitor in a predetermined state of charge until receipt of said start signal.

5. A time interval meter in accordance with claim 1 wherein said means for measuring said second time interval comprises a counter for counting clock pulses, said counter being enabled upon receipt of said interval stop signal and being disabled when said timing circuit reaches the upper limit of said predetermined timing window.

6. A circuit for measuring a time interval between a first and second event, comprising:

a timing circuit including a capacitor which produces a fast ramp at a first predetermined rate and a slow ramp at a second predetermined rate between a first reference voltage and a second reference voltage, said fast ramp being initiated at said first reference voltage by said first event and being terminated at an unknown voltage between said first and second reference voltages by said second event, and said slow ramp being initiated at said unknown voltage by said second event and being terminated at said second reference voltage, the total time period between said first and second reference voltages being determined by said second predetermined rate;

means connected to said timing circuit for measuring the time interval of said slow ramp; and means for subtracting the measured time interval of said slow ramp from said total time period thereby to provide the time interval of said fast ramp.

7. A circuit in accordance with claim 6 wherein said timing circuit further includes first and second constant current sources connectable to said capacitor to provide charging current therefore, and a comparator having one input thereof connected to said capacitor and a second input thereof connected to said second reference voltage, the output of said comparator being applied to said slow ramp time interval measurement means.

8. A circuit in accordance with claim 7 wherein said slow ramp time interval measurement means comprises a counter which counts clock pulses during said slow ramp time interval, said counter being enabled by said second event and being disabled by said comparator output.

9. A circuit in accordance with claim 8 further including a control circuit responsive to start and stop signals corresponding respectively to said first and second events for controlling the sequence of operation of said timing circuit and said counter.

* * * * *